US009807521B2

(12) United States Patent
Werner, Jr. et al.

(10) Patent No.: US 9,807,521 B2
(45) Date of Patent: Oct. 31, 2017

(54) METHOD AND APPARATUS FOR INTELLIGENT ACOUSTIC SIGNAL PROCESSING IN ACCORDANCE WITH A USER PREFERENCE

(75) Inventors: Alan J. Werner, Jr., Rochester, NY (US); Malcolm Bugler, West Henrietta, NY (US)

(73) Assignee: Alan J. Werner, Jr., Rochester, NY (US)

( * ) Notice: Subject to any disclaimer, the term of this patent is extended or adjusted under 35 U.S.C. 154(b) by 1184 days.

(21) Appl. No.: 11/782,321

(22) Filed: Jul. 24, 2007

(65) Prior Publication Data

US 2008/0044040 A1 Feb. 21, 2008

Related U.S. Application Data

(63) Continuation-in-part of application No. 11/254,448, filed on Oct. 20, 2005, now abandoned.

(60) Provisional application No. 60/820,178, filed on Jul. 24, 2006, provisional application No. 60/621,560, filed on Oct. 22, 2004.

(51) Int. Cl.
*H04R 3/00* (2006.01)
*H04R 25/00* (2006.01)

(52) U.S. Cl.
CPC ..... *H04R 25/43* (2013.01); *H04R 25/407* (2013.01); *H04R 25/505* (2013.01); *H04R 2420/07* (2013.01); *H04R 2430/20* (2013.01)

(58) Field of Classification Search
CPC ..... H04R 3/005; H04R 1/406; H04R 5/027; H04R 2201/401; H04R 27/00; H04R 1/326; H04R 2420/07; H04R 25/552; H04R 2203/12; H04R 2225/43; H04R 2499/11; H04R 25/407
USPC ..... 381/111, 92, 94.1–94.3, 380, 374, 370, 381/74, 312, 313
See application file for complete search history.

(56) References Cited

U.S. PATENT DOCUMENTS

| | | | |
|---|---|---|---|
| 2,337,953 A | 12/1943 | Wirsching | |
| 4,344,425 A | 8/1982 | Strauss | |
| 4,441,576 A | 4/1984 | Allen | |
| 4,552,137 A | 11/1985 | Strauss | |
| 4,751,738 A | 6/1988 | Widrow et al. | |
| 4,852,683 A | 8/1989 | Killion | |
| 5,113,967 A | 5/1992 | Killion | |

(Continued)

FOREIGN PATENT DOCUMENTS

| | | | | |
|---|---|---|---|---|
| DE | 102004035256 | | 9/2005 | |
| JP | 56010793 | * | 7/1979 | ..... H04R 3/00 |

(Continued)

OTHER PUBLICATIONS

Neumann, J.; Gabriel, K.; CMOS-MEMS Membrane Structure for Audio-Frequency Acoustic Actuation; MEMS Laboratory, Carnegie Mellon University, Pittsburgh PA USA 15213; 2 pages.

(Continued)

*Primary Examiner* — Lun-See Lao
(74) *Attorney, Agent, or Firm* — Duane C. Basch; Basch & Nickerson LLP

(57) ABSTRACT

The present invention is directed to a "smart earplug" capable of selectively adjusting the output of an array of acoustic wave generation elements or speakers within a user's ear canal in response to input signals, wherein at least one of the input signals has been at least partially attenuated.

15 Claims, 7 Drawing Sheets

(56) References Cited

U.S. PATENT DOCUMENTS

| | | | | |
|---|---|---|---|---|
| 5,276,740 | A * | 1/1994 | Inanaga et al. | 381/382 |
| 5,396,563 | A | 3/1995 | Yoshimi | |
| 5,434,924 | A | 7/1995 | Jampolsky | |
| 5,506,910 | A * | 4/1996 | Miller et al. | 381/103 |
| 5,647,377 | A | 7/1997 | Shinabarger | |
| 5,673,325 | A * | 9/1997 | Andrea et al. | 381/92 |
| 5,680,466 | A | 10/1997 | Zelikovitz | |
| 5,692,059 | A | 11/1997 | Kruger | |
| 5,737,430 | A | 4/1998 | Widrow | |
| 5,742,693 | A | 4/1998 | Elko | |
| 5,793,875 | A * | 8/1998 | Lehr et al. | 381/313 |
| 5,917,918 | A | 6/1999 | Callahan | |
| 5,937,070 | A | 8/1999 | Todter et al. | |
| 5,957,136 | A | 9/1999 | Magidson et al. | |
| 5,978,689 | A | 11/1999 | Tuoriniemi et al. | |
| 5,983,399 | A | 11/1999 | Falco et al. | |
| 6,068,079 | A | 5/2000 | Hamery et al. | |
| 6,069,964 | A | 5/2000 | Yang | |
| D427,304 | S | 6/2000 | Magidson et al. | |
| 6,082,485 | A | 7/2000 | Smith | |
| D434,139 | S | 11/2000 | Foslien | |
| D435,036 | S | 12/2000 | Koss et al. | |
| 6,163,615 | A | 12/2000 | Callahan | |
| D436,164 | S | 1/2001 | Foslien | |
| D444,141 | S | 6/2001 | Koss et al. | |
| D445,894 | S | 7/2001 | Remer et al. | |
| 6,264,870 | B1 | 7/2001 | Hakansson | |
| 6,286,622 | B1 | 9/2001 | Tiemann | |
| 6,340,227 | B1 | 1/2002 | Solberg et al. | |
| 6,424,721 | B1 * | 7/2002 | Hohn | 381/313 |
| 6,425,398 | B1 | 7/2002 | Hirshfeld | |
| 6,470,197 | B1 | 10/2002 | Tuoriniemi et al. | |
| 6,484,726 | B1 | 11/2002 | Remer et al. | |
| D467,333 | S | 12/2002 | Martinson | |
| D472,627 | S | 4/2003 | Falco | |
| D478,658 | S | 8/2003 | Falco | |
| 6,665,410 | B1 | 12/2003 | Parkins | |
| 6,691,822 | B2 | 2/2004 | Meussen et al. | |
| 6,704,429 | B2 | 3/2004 | Lin | |
| 6,714,654 | B2 * | 3/2004 | Lichtblau | 381/317 |
| 6,728,385 | B2 * | 4/2004 | Kvaløy et al. | 381/328 |
| 6,754,359 | B1 | 6/2004 | Svean et al. | |
| D492,765 | S | 7/2004 | Falco | |
| D492,766 | S | 7/2004 | Falco | |
| D493,219 | S | 7/2004 | Falco | |
| 6,768,803 | B1 | 7/2004 | Duhamel | |
| D494,268 | S | 8/2004 | Fleming | |
| 6,772,854 | B2 | 8/2004 | Wubker | |
| 6,970,571 | B2 * | 11/2005 | Knorr et al. | 381/370 |
| 7,013,014 | B2 * | 3/2006 | Ach-Kowalewski et al. | 381/313 |
| 7,369,669 | B2 * | 5/2008 | Hagen et al. | 381/313 |
| 7,394,911 | B2 * | 7/2008 | Joergensen et al. | 381/322 |
| 7,542,582 | B2 | 6/2009 | Connors et al. | |
| 2002/0106094 | A1 | 8/2002 | Fujino | |
| 2005/0169483 | A1 * | 8/2005 | Malvar et al. | 381/58 |
| 2006/0018496 | A1 | 1/2006 | Niederdrank et al. | |
| 2006/0088176 | A1 | 4/2006 | Werner | |

FOREIGN PATENT DOCUMENTS

| | | |
|---|---|---|
| JP | 04-61996 | 5/1992 |
| JP | 08-79897 | 3/1996 |
| JP | 2000032597 | 1/2000 |
| JP | 2000059893 | 2/2000 |
| JP | 2000253498 | 9/2000 |
| JP | 2000261894 | 9/2000 |
| JP | 2000354290 | 12/2000 |
| JP | 2001320800 | 11/2001 |
| JP | 2002152873 | 5/2002 |
| WO | WO2005006808 | 1/2005 |

OTHER PUBLICATIONS

Earplugs; Download from The Ear Plug Super Store Aug. 3, 2004; 5 pages.

Oestreich, James; The Shushing of the Symphony; {Published Jan. 11, 2004; c. 2004 The New York Times Company.

An Unofficial Copy of the File History as of Sep. 3, 2009 for U.S. Appl. No. 11/254,448.

An Unofficial Copy of the File History, as of Sep. 10, 2009 for U.S. Appl. No. 60/820,178.

An Unofficial Copy of the File History, as of Sep. 10, 2009 for U.S. Appl. No. 60/621,560.

An unofficial copy of a Supplemental European Search Report dated Jun. 15, 2011 for European Patent Application 05817294.1 filed Oct. 20, 2005 corresponding to U.S. Appl. No. 11/254,448; Inventor Werner, Alan.

An abstract and machine translation of JP2000354290 published Dec. 19, 2000, Toa Corp.

JP 2007-538020—An unofficial copy of the prosecution history for Japanese Patent Application 2007-538020 filed Oct. 21, 2005; published May 29, 2008 as JP 2008-518512; Inventor Werner et al; corresponding to U.S. Appl. No. 11/254,448 including office actions dated Dec. 14, 2010 and Jun. 2, 2011 (translations included).

JPO4-61996 1 page extract translation of JPO4-61996 published May 27, 1992 for "Hearing Aid", applicant GSD Co., Ltd.

JP08-79897 Machine Translation of JP08-79897 published Mar. 22, 1996 for "Hearing Aid", applicant SONY Corp;JP application 06-209505 file Sep. 2, 1994.

JP2000032597 Machine Translation of JP2000032597.

JP2000059893 Machine Translation of JP2000059893.

JP2000253498 Machine Translation of JP2000253498.

JP2000261894 Machine Translation of JP2000261894.

JP2002152873 Machine Translation of JP2002152873.

JP2001320800 Machine Translation of JP2001320800.

DE10200403525633 equivalent US2006018496—US publication US2006018496.

JP 2007-538020—An Unofficial Copy of the Prosecution History Between Jun. 2011 and May 29, 2012 for Japanese Patent Application 2007-538020 Filed Oct. 21, 2005, Published May 29, 2008, as 2008-518512; Corresponding to U.S. Appl. No. 11/254,448; Inventor: Alan J. Werner Jr.

U.S. Appl. No. 11/254,448—An Unofficial Copy of the Prosecution History as of May 29, 2012 for U.S. Appl. No. 11/254,448, filed Oct. 20, 2005, Published Apr. 27, 2006, as US2006/0088176 A1; Inventor: Alan J. Werner Jr.

EP05817294.1—An Unofficial Copy of a European Office Action dated Oct. 1, 2012 for European Patent Application 05817294.1 Filed Oct. 21, 2005; Corresponding to U.S. Appl. No. 11/254,448; Inventor: Alan J. Werner Jr.

* cited by examiner

METHOD AND APPARATUS FOR INTELLIGENT ACOUSTIC SIGNAL PROCESSING IN ACCORDANCE WITH A USER PREFERENCE

This application is a Continuation-in-Part of U.S. application Ser. No. 11/254,448 for a "METHOD AND APPARATUS FOR INTELLIGENT ACOUSTIC SIGNAL PROCESSING IN ACCORDANCE WITH A USER PREFERENCE," filed Oct. 20, 2005, and claims priority from U.S. Provisional Application 60/621,560 by Alan J. Werner for a "METHOD AND APPARATUS FOR INTELLIGENT ACOUSTIC SIGNAL PROCESSING IN ACCORDANCE WITH A USER PREFERENCE," filed Oct. 22, 2004, and the present application further claims priority from U.S. Provisional Application 60/820,178 by Alan J. Werner for a "METHOD AND APPARATUS FOR INTELLIGENT ACOUSTIC SIGNAL PROCESSING IN ACCORDANCE WITH A USER PREFERENCE," filed Jul. 24, 2006, all of which are hereby incorporated by reference in their entirety.

The present invention is directed to an acoustic control apparatus and method, and more particularly to a "smart earplug" that is capable of selectively adjusting the output of an array of acoustic wave generation elements in response to input signals, wherein at least one of the input signals has been at least partially attenuated.

BACKGROUND AND SUMMARY

The following patent is noted and the teachings thereof are hereby incorporated by reference: U.S. Pat. No. 6,768,803, to Duhamel, issued Jul. 27, 2004 for a "METHOD AND APPARATUS FOR SELECTIVE ACOUSTIC SIGNAL FILTERING."

It is well known that noise in the work place can both mask important audio "information" and cause permanent physical damage to the human "hearing" system. For example, in the heavy construction industry, the wearing of sound blocking "ear muffs" is a common solution. The problem also exists in the performing arts arena, particularly in the "loud" jazz and heavy rock music communities. The normal solution is to use earplugs, which are small, rubbery or foam devices that are inserted into the ear channel to "block" the sound. However, such devices tend to block out or attenuate all of the acoustic signals, thereby reducing or eliminating certain signals to a level where they cannot be heard or appreciated by the listener.

A similar problem exists in the classical music industry as James R. Oestrich suggests in an article published on Jan. 11, 2004 in the New York Times. Auditory acuity and sensitivity are especially important to the musician and even a subtle hearing deficit may detract from the musician's performance, and in extreme cases, severe hearing loss could mean an end to a performing career. The Occupational Safety and Health Administration (OSHA) regulates noise levels in the workplace and exposure levels within the Orchestra may not exceed an 8 hour Time Weighted Average (TWA) of 90 dBA. The ceiling level is 115 dBA, meaning that and at no time may this level be exceeded 115 dBA. Exposure to excessive sound levels can cause damage in two ways: mechanical trauma and sensorineural hearing loss. Sensorineural hearing loss, caused by repeated exposure to excessive noise levels, is of most concern to musicians. In addition to the auditory effects, noise can cause physiological and/or psychological problems as well. The physiological effects may include a wide variety of symptoms including increased heart rate, blood pressure, breathing rate, muscle contractions and perspiration. Psychological complaints may include nervousness, tension, anger and irritability.

However, this problem has not been addressed due to the inherent limitations of conventional hearing aids or ear plugs, including lack of control as to the amount of attenuation desired by a listener, as well as a control over the directionality of the attenuation. In other words, performers may wish to more heavily attenuate the percussion or brass section behind them, but to keep the woodwinds to the side or strings in front of them at a higher or non-attenuated level. In any live musical performance, it is critical to "hear" exactly what is going on around you. This may be for better balance, a matching of tonal quality, a "clue" as to when to play, etc. Not only is this "audio information" important, but so is the location or direction from which it is coming.

As mentioned above, the problem with the conventional ear muff and ear plug approaches is that not only is the quality of the sound changed, but that any directionality is lost. The present invention is, therefore, directed to an improved or "smart" ear plug (in the ear or not), that provides true acoustic rendition of the sound, wherein the amplitude or similar signal characteristics of the acoustic signal may be controlled on a directional basis.

The advent of micro-electronics provides new options for the sensing and delivery of acoustic information or signals. Micro-electronics makes physically small circuitry and electromechanical systems possible. In accordance with one aspect of the present invention, there is provided an array of very small micro-electromechanical systems (MEMS) microphones to detect the acoustic waves or vibrations coming from a plurality of directions (e.g., front/rear, left/right side, above, below, etc.). Having received the various, discrete signals from the array of MEMS microphones, with their inherent directionality; a similar array of MEMS speakers or "audio transducers", could be used to generate the output (perhaps conditioned to attenuate the signal from certain directions more than other directions). Thus, the system would provide a user with all of the audio information, but with selective attenuation (or gain) based upon directionality of the acoustic source—providing the impression of being from the same direction with the same audio information but at a user adjustable sound level.

In accordance with the present invention, there is provided an acoustic control apparatus, comprising: input sensor for receiving an input acoustic signal to be processed, said input sensor including a microphone array, said microphone array manifesting vibration in response to interaction with the input acoustic signals from a plurality directions to generate a plurality of input signals, each representing an acoustic input from one of the plurality of directions relative to said input sensor; a signal processing device for producing, in response to the input signals, at least one output signal, said signal processing device characterized by a uniform frequency response such that the output acoustic signal spectrum level is generally reflective of an input acoustic signal spectrum level, said signal processing device further including a mixing circuit to enable a mixing of at least two acoustic signals from the plurality of directions; and an acoustic output port for generating the output acoustic signal produced by said signal processing device.

In accordance with another aspect of the invention, there is provided an acoustic signal processing system for processing acoustic signals in accordance with a user preference, comprising: at least one microphone array, said microphone array generating a plurality of input signals in response to acoustic vibrations, each input signal representing an acoustic input from one of a plurality of directions relative to said microphone array; a signal processing device for producing, in response to the plurality of input signals, at least one output signal, said signal processing device characterized by a uniform frequency response such that an output acoustic signal spectrum level is generally reflective of an input acoustic signal spectrum level, said signal processing device further including a mixing circuit with a crossover network, responsive to the user preference, to mix at least two acoustic signals from the plurality of directions; and at least one speaker for generating the output acoustic signal in response to the output signal from said signal processing device.

In accordance with a further aspect of the invention, there is provided a method for controlling the sound perceived by a user, comprising: receiving, using a micro-electronic microphone array, an input acoustic signal and generating a plurality of input signals representing the acoustic input from each of a plurality of directions relative to the array; processing the input signals to produce at least one output signal such that the output signal spectrum level is generally reflective of an input acoustic signal spectrum level, including mixing of at least two acoustic signals from the plurality of directions to produce the at least one output signal; and generating, by an output speaker responsive to the at least one output signal an acoustic signal directly in the canal of a user's ear.

The techniques described herein are advantageous because they provide a reduced-size method of controlling the audio or acoustic input received by a user, thereby enabling a user to function in an acoustically unfriendly environment without the complete loss or exclusion of acoustic information. The techniques of the invention are advantageous because they provide a range of alternatives, each of which is useful in appropriate situations. As a result of the invention, it is anticipated that musicians, construction workers and the like may find improved on-the-job experience and reduced hearing loss due to loud noises.

Figure 1:
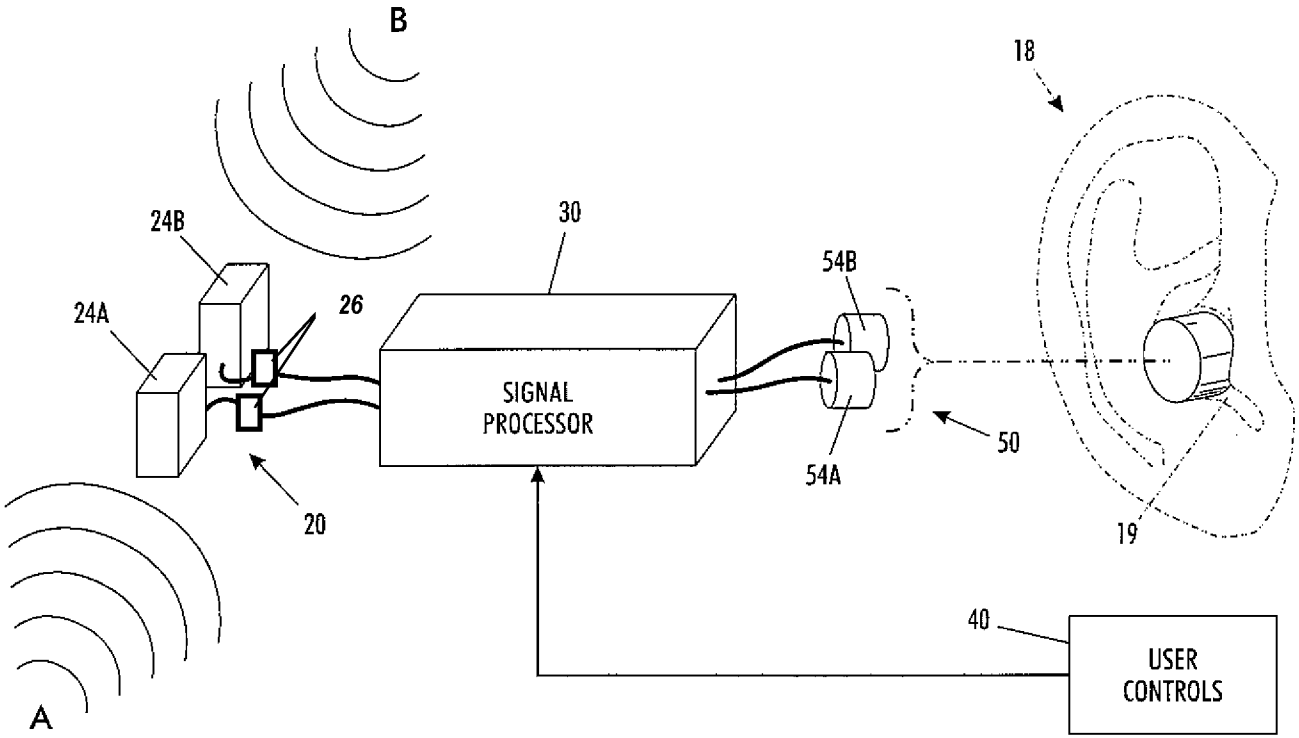
FIG. 1 is an exemplary assembly-type illustration of an embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are not to scale and some portions thereof may be depicted in a disproportionate fashion in order to depict detail.

The invention is directed to a "smart ear plug" that is dynamically controllable by a user. In one embodiment the device uses a system of four very small microphones, an "in ear" headset and a user worn control panel. It is battery powered. The microphone "set" consists of two microphone pairs. Each pair has one microphone aimed to the back of the user and one microphone aimed to the front of the user. One pair is for the left ear and the other is for the right ear. Full frequency response is maintained (20 Hz to 20 KHz) to maintain the "quality" of the sound. It is further contemplated that one or more of the microphones in the microphone set includes an amplifier to amplify the signal produced by the microphone (on-board), before the signal is transferred to other components for further processing, etc.

Set up is simple: the user adjusts the signal from the front microphones so that the user hears no difference using the system or not using the system. Thus the sound level of the persons adjacent to the user is the same with the system on or off. This is critical between musicians who must balance with each other such as the musicians immediately next to them. Critical examples are the principal and second of a section and principals of adjacent sections such as oboe, flute and clarinet. The levels from the rear where the inherently loud instruments such heavy brass and percussion are located are then reduced to a safe level for the user. There is also a left-right balance basically useful for the string sections.

Referring to FIG. 1, depicted therein is an exemplary embodiment of the present invention for an acoustic control/filtering apparatus suitable for use by a classical musician or the like. In one embodiment, the apparatus comprises an input sensor 20 for receiving an input acoustic signal to be processed. Sensor 20 includes an array of directionally oriented microphones 24A, 24B for sensing sound from locations A and B, respectively. As depicted in the figure, microphones 24A and 24B might be employed to sense the directionality of acoustic vibrations coming say from front (A) and rear (B) positions relative to the user's ear 18. It will be appreciated that the input sensor such as microphone array 20 will serve to manifest the acoustic vibration and thereby generate a plurality of input signals (at least A and B), each representing an acoustic input from one of a plurality of directions relative to said sensor 20.

Although not depicted, it will be appreciated that various configurations for sensor 20 may be employed, including additional microphones 24. It will also be appreciated that the directionality of the various microphones in the array may be enhanced through the use of baffles or similar means for isolating or separating the microphones in the array. As depicted, for example, in FIGS. 4A and 4B, the microphones may be mounted on the opposite sides a printed circuit board 23. Although described relative to a microphone array, the present invention may be produced with only a single microphone operating for each ear of the user, so that the term microphone array may include one or more microphones. The same would be true, of course, for speakers employed in each ear of the user—where one or more speakers may be used in each ear.

In one embodiment, the microphones 24 are preferably micro-electronic or MEMS-type devices suitable for attaching to or embedding within a small device such as an earplug. It is also contemplated that MEMS and/or piezoelectric materials may be employed in the microphone or speaker elements of the present invention. Although described relative to a user-wearable device, it will be appreciated that various aspects of the present invention may be employed in a larger-scale version of the invention, and accordingly, such scale is not an inherent limitation of the present invention.

Figure 2:
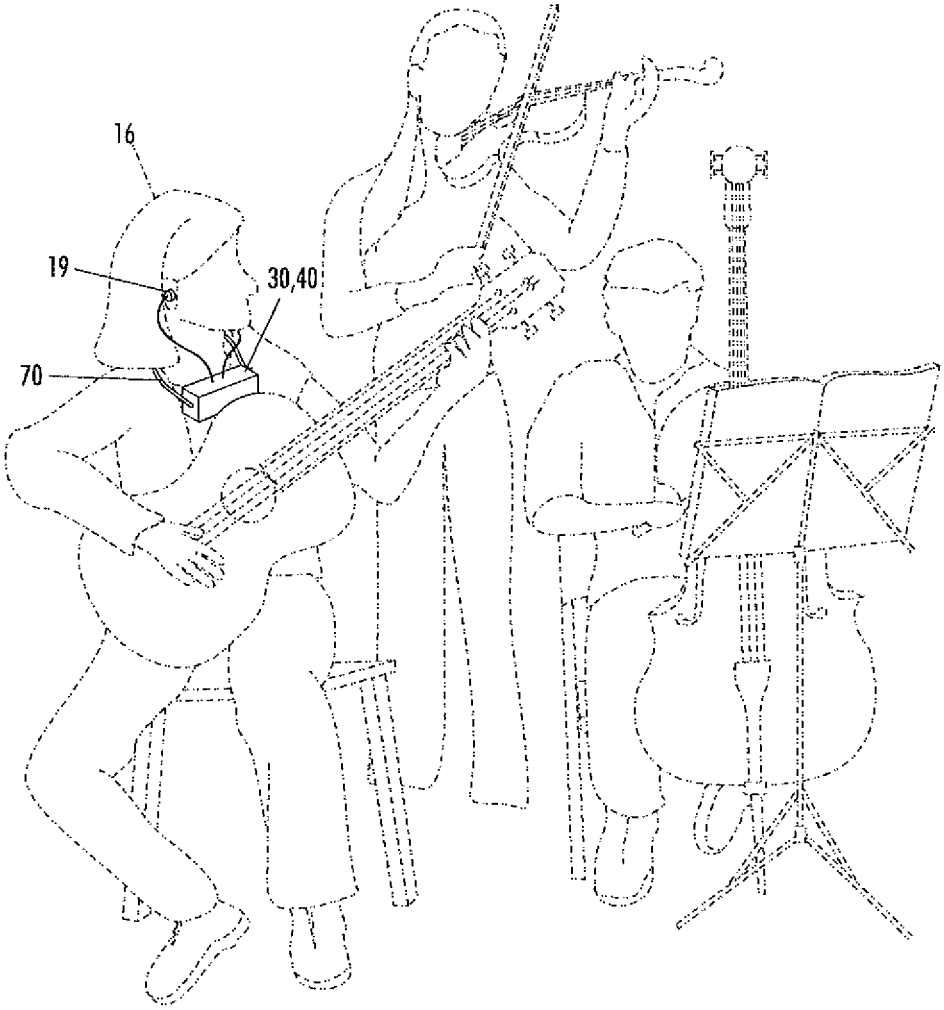
FIG. 2 is an illustrative embodiment of the invention, wherein user controls are worn on a necklace by a musician.
Figure 3:
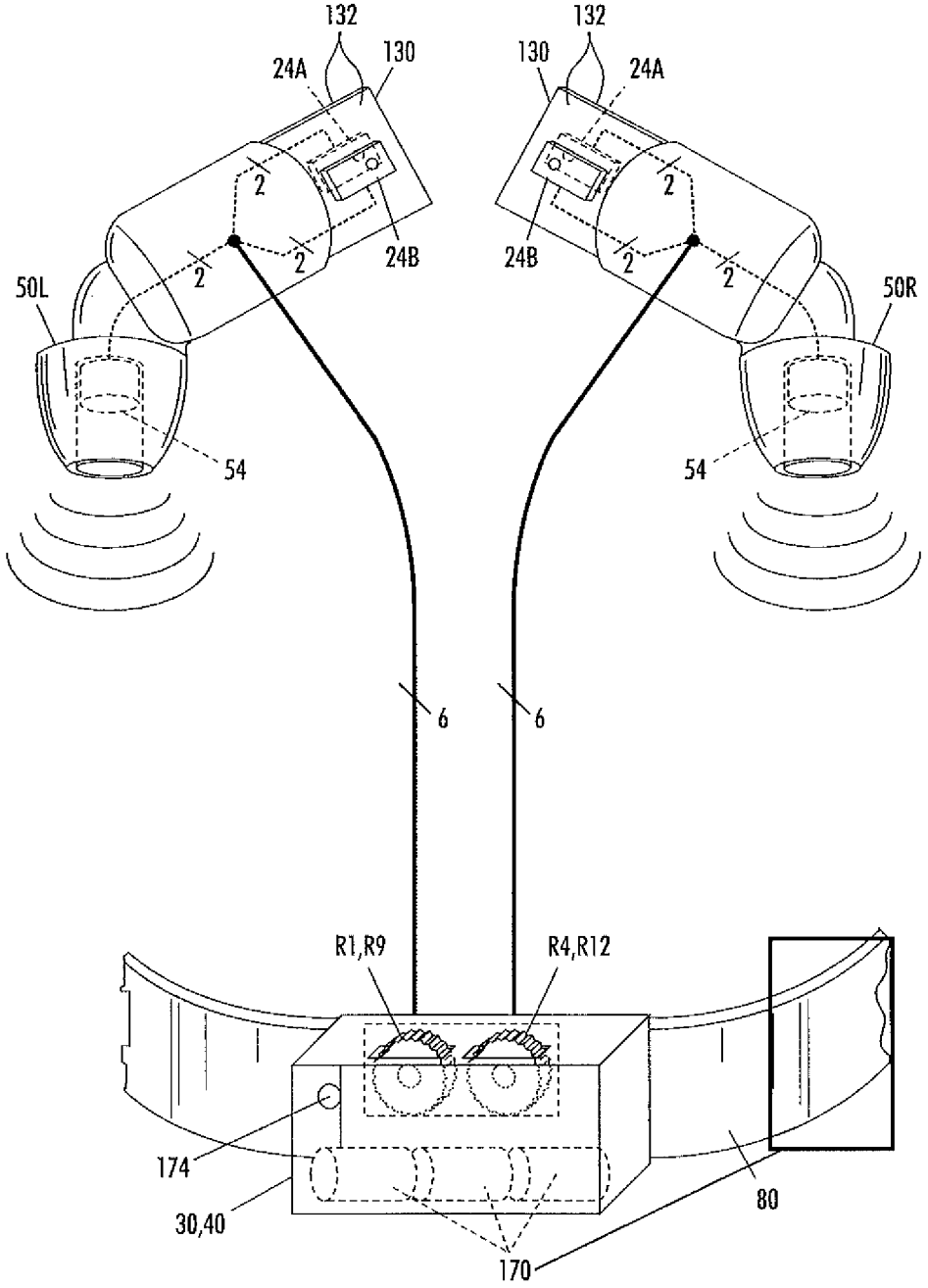
FIGS. 3 and 4A-4B is another embodiment of the invention, wherein the user controls and power supply are located on a belt for attachment to a user.

Referring next to FIG. 2, it will be appreciated that various embodiments of the present invention may be employed to attach the system, depending upon the user's needs. As depicted in the figure, musician 16 would have one or more components of the present invention inserted into her ear(s), and would wear a necklace or strap 70 upon which the control and processing module (30. 40) would be attached as a pendant. Alternatively, recognizing that in many cases a necklace/pendant combination would not be desirable, the embodiment of FIG. 3 depicts a belt or strap 80, to which the module is attached to permit the user to wear the system around his/her arm, waist, etc. It will also be appreciated that various components of the described system may be incorporated into or on clothing or other garments (e.g., pockets, vests, caps, hats, headbands, etc.) and the like to permit ease of use.

Although the present disclosure is directed to embodiments wherein the acoustical signal processing apparatus is used by musicians, it is also contemplated that such devices may be used in other applications, particularly those where the user wants or needs to have control over not only the direction of sound that is partially attenuated, but possibly over the frequency range of sound as well. For example, the present invention is contemplated for use by persons having learning disabilities, where the person is highly sensitive to sound or certain frequencies, whereby the person could employ the present invention to reduce background noise to permit the person to study or perform in an uninterrupted fashion. The present is also believed to be suitable for use by musical instructors and those working in or exposed to similar environments.

As illustrated in FIG. 1, each of the microphones or similar acoustic sensing means 24A, B generate an output signal that is transferred or transmitted via wires or traces on a circuit board to a signal processing device 30. As noted previously, one or more of the microphones in the acoustic sensing means or microphone may provide its output to an amplifier or pre-amplifier (26) to amplify the signal produced by the microphone, preferably on-board, before the signal is transferred or transmitted via the wires or traces. Use of the amplifier is believed to improve the signal-to-noise ratio of the input signal that transferred to the signal processing device 30.

The signal processing device 30 produces, in response to the input audio signals, at least one output signal. The present invention contemplates, as described in detail below, that the signal processor may operate in response to user selections, adjustments or preferences, whereby the output signals will be adjusted in accordance with the user's preferences. In one embodiment, the signal processing device provides a uniform frequency response such that the output acoustic signal spectrum level is generally reflective of an input acoustic signal spectrum level, while maintaining the directionality thereof.

The signal processing device may comprise a simple set of potentiometers and associated thumbwheels 410 as used in conventional hearing aids to adjust volume levels, a suitable amplifier such as an operational amplifier capable of driving the output speakers, headset, or "ear buds" along with suitable resistors and capacitors commonly used in conventional circuit designs well known to those skilled in the art of analog circuit design. In the embodiments depicted, the additional feature of a mixing circuit 42 has been added. Further details of an exemplary design will be described below relative to FIGS. 4A-4B. The device would preferably be responsive to acoustic signals over a full frequency range of about 20 Hz to 20 KHz; albeit a reduced range of 50 Hz to 15 KHz may prove to be acceptable.

Figure 6:
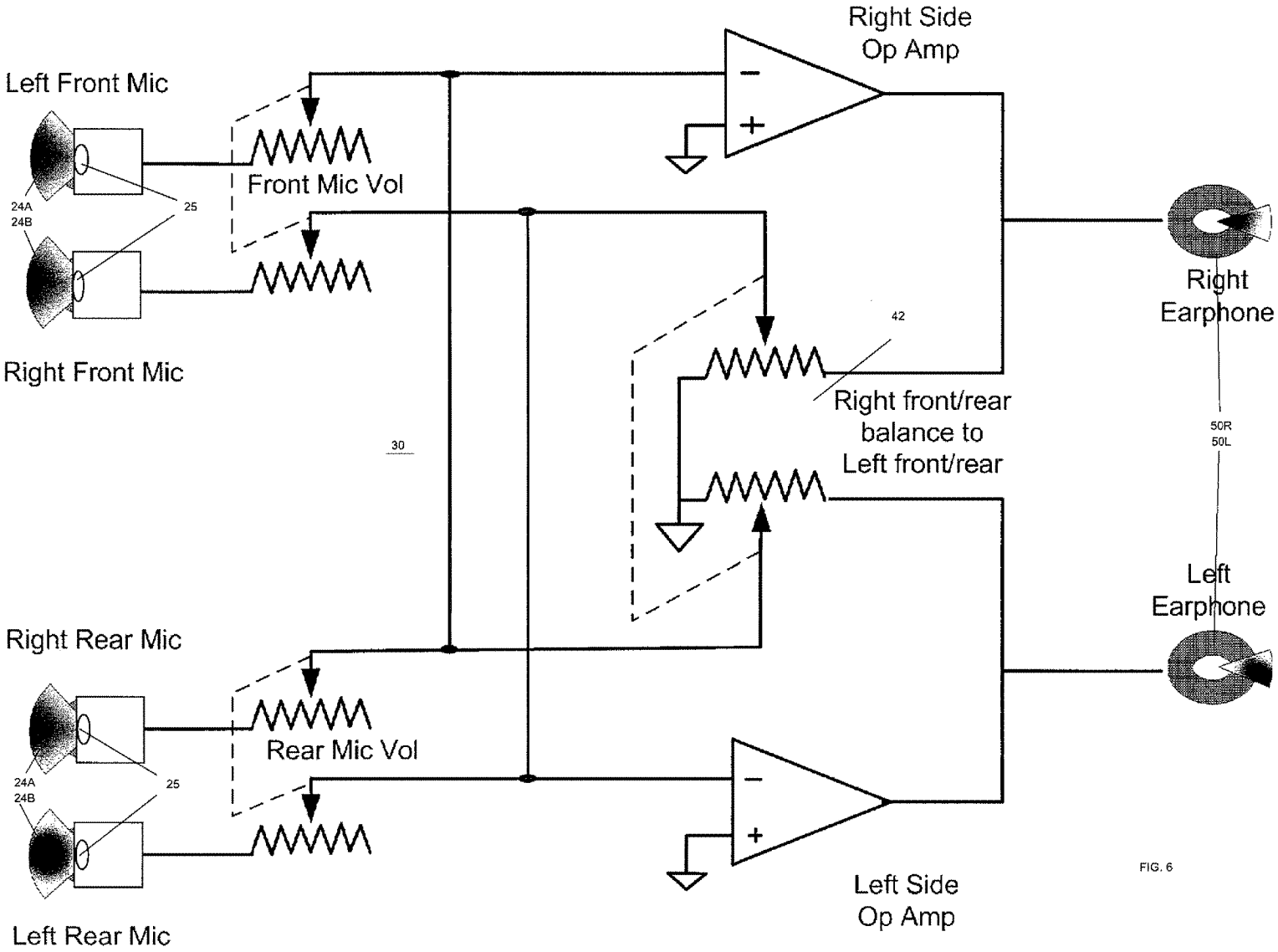
FIG. 6 is an exemplary block diagram of an embodiment of the invention as depicted in FIG. 5.

In one embodiment, various component manufacturers may supply suitable microphone and/or ear buds; for example, Knowles Acoustics, a division of Knowles Electronics LLC has an extensive selection of such microphones (SiSonic, e.g., Model SP0103) and speaker elements. Presently electret microphones from Knowles are being used. As shown, for example, in FIGS. 3 and 6 microphones 24 look like very small cylinders—with a hole 25 at one end where the sound enters and three pads (not shown) on the back that mount on the PWBA 23. In the embodiment depicted in FIG. 3 the microphone assembly looks a bit like a PWBA with back to back microphones in its center. The microphones may also be in purchased from Radio Shack® and are basically the same type of electret device, but appear to be more sensitive, and may include some sort of circuit inside them.

It is also important to note that the signal processing device should be suitable for interfacing with MEMS-type devices, including microphones and/or speakers, and should include driver circuitry suitable for conditioning the signals to/from such devices. Although MEMS-type microphones are understood to be considered "noisy" they may nonetheless prove to be suitable, and even desirable from a size reduction perspective, for some embodiments of the present invention.

Referring again to FIG. 1, an acoustic output port 50 is provided in the form of an array of speakers 54A, B, or similar elements, for releasing the output acoustic signal produced by the signal processing device 30. In particular, the present invention contemplates the use of a prototype earphone using CMOS-MEMS micromachining techniques that is audible from 1 to 15 kHz and was produced by John J. Neumann, Jr. and Kaigham J. Gabriel at Carnegie Mellon University. Other possibilities are miniature speaker assemblies such as the Knowles balanced armature speakers and "ear buds" such as the Shure E-series earphones. In one embodiment, the invention includes a conformable and/or molded portion that is inserted into the user's ear canal. The conformable or molded material occludes the canal of the user's ear and thereby substantially prevents the user's perception of the ambient sound except what has been processed and output by the speaker or output port 50.

Having described the basic configuration of an embodiment of the present invention, attention is now turned to additional features that may be incorporated with or in the "smart ear plug" device. More specifically, the user controls 40 are intended to provide adjustment capability for the present invention. In one embodiment, the signal processing device processes the input signals in a manner so that the output acoustic signal includes an attenuated signal from at least one of the plurality of directions. To control the level of attenuation and the direction, it is contemplated that a balance/fader or similar signal direction adjustment, for example mixing circuit 42, may be employed in combination with a volume or attenuation control. For example, such a device may be employed to reduce the volume (higher signal attenuation) of the trombones located behind the user (e.g., position B), while not reducing the volume of signals from the balance of the orchestra in front of the user (e.g., position A).

As noted above, the output port 50 preferably comprises an array of miniature (e.g., MEMS) speakers, each of which receives and is responsive to one of a plurality of output signals generated by the signal processor 30.

Although depicted in a larger configuration in FIG. 1, for purposes of illustration, the present invention ideally fits near or inside the ear channel 19 in much the same way current "ear plugs" do. Alternately, the maximum size would be that of current miniature commercial hearing aids or similar devices, and may include one or more directional microphones that are spaced apart from the processor and speaker array. One goal is that such devices remain essentially invisible to an audience, as well as have minimal effect on the comfort of the user.

Figure 4A:
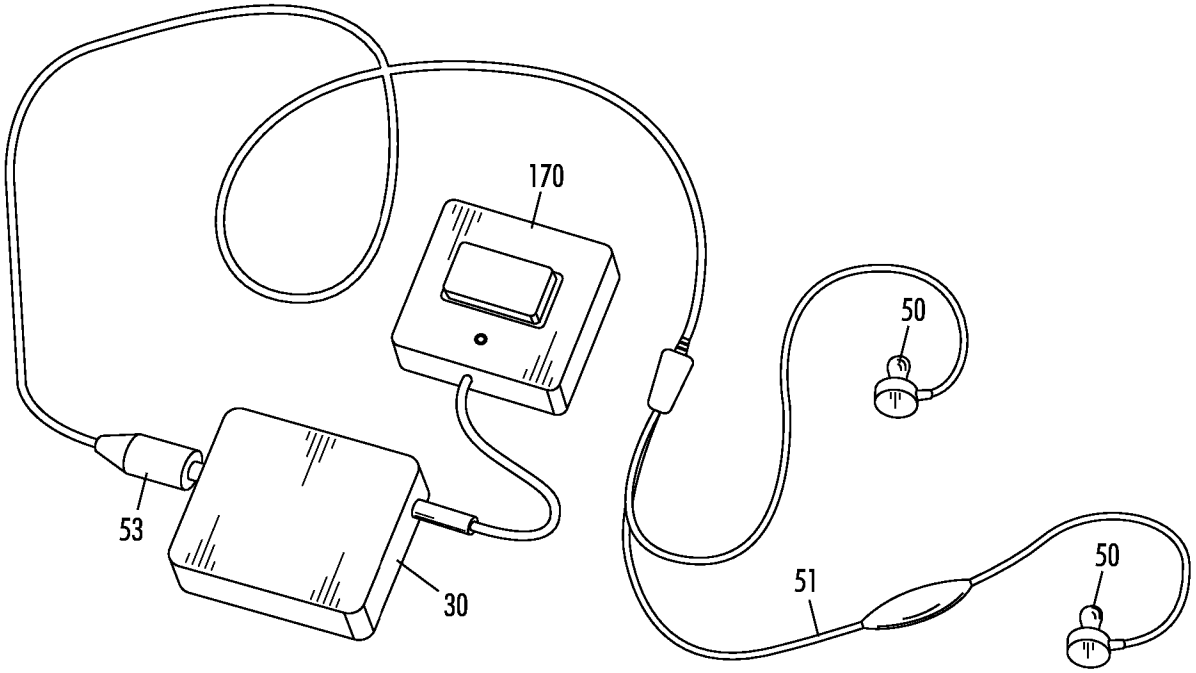
Figure 4B:
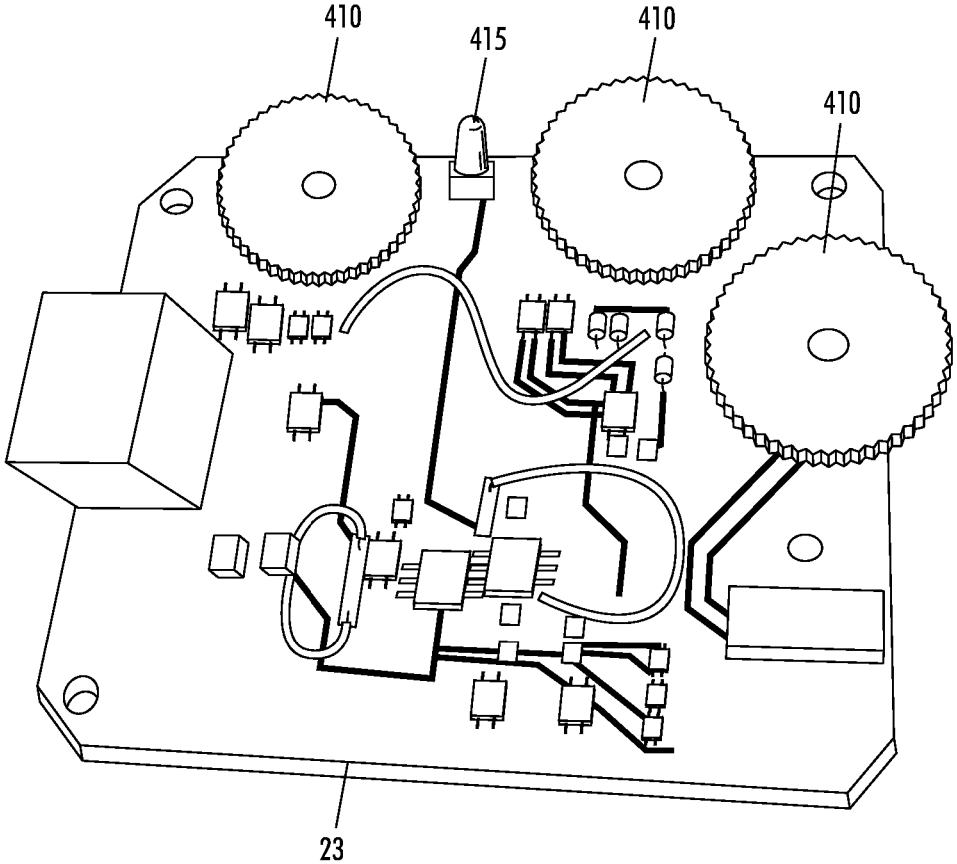

Having generally described an embodiment of the invention, and various applications thereof, attention is now turned to FIGS. 3 and 4A-4B where an embodiment of the invention is depicted as a prototype. Here again, the figures depict an acoustic signal processing system for processing acoustic signals in accordance with a user's preference. On each ear bud 50L and 50R (L and R indicating left and right sides, respectively), there is positioned at least one microphone array 24A, 24B. As will be appreciated, each microphone or microphone array generates a plurality of input signals in response to acoustic vibrations received by the microphone. Each input signal represents an acoustic input from one of a plurality of directions relative to said microphone array.

More specifically, the array 24A-B in a user's left ear would sense acoustic energy (e.g., sound, noise) perceptible from the user's left side. In one embodiment, microphone 24A-B is a micro-electromechanical system as described above. Moreover, the ear bud 50L may be oriented so that the microphones 24A and 24B are, respectively, oriented toward the front and rear. The system depicted in FIG. 3 further includes, on the ear bud, a baffle 130 (which may be circuit board 23), wherein the baffle separates the first (24A) and second (24B) microphones of the microphone array. It will be further appreciated that the baffle may be made from a resilient material, albeit one that preferably does not transfer acoustic energy to better assure the independent operation of each of the microphones. Moreover, the baffle 130 may be integrated with, or comprise, the circuit board 23 upon which the components described below may be mounted, possibly including connections made through RTV silicone rubber or similar edge connection means. Although not specifically depicted, one or more surfaces 132 of the baffle 130 may be parabolic in shape or have a configuration that selectively focuses or directs the acoustic energy from at least one direction toward the microphone. It should also be appreciated that although shown with two microphones on each of the left and right sides, the present invention is not to be so limited, and may include three or more microphones in an array on each ear bud in order to improve the user's sense of directionality.

Figure 5:
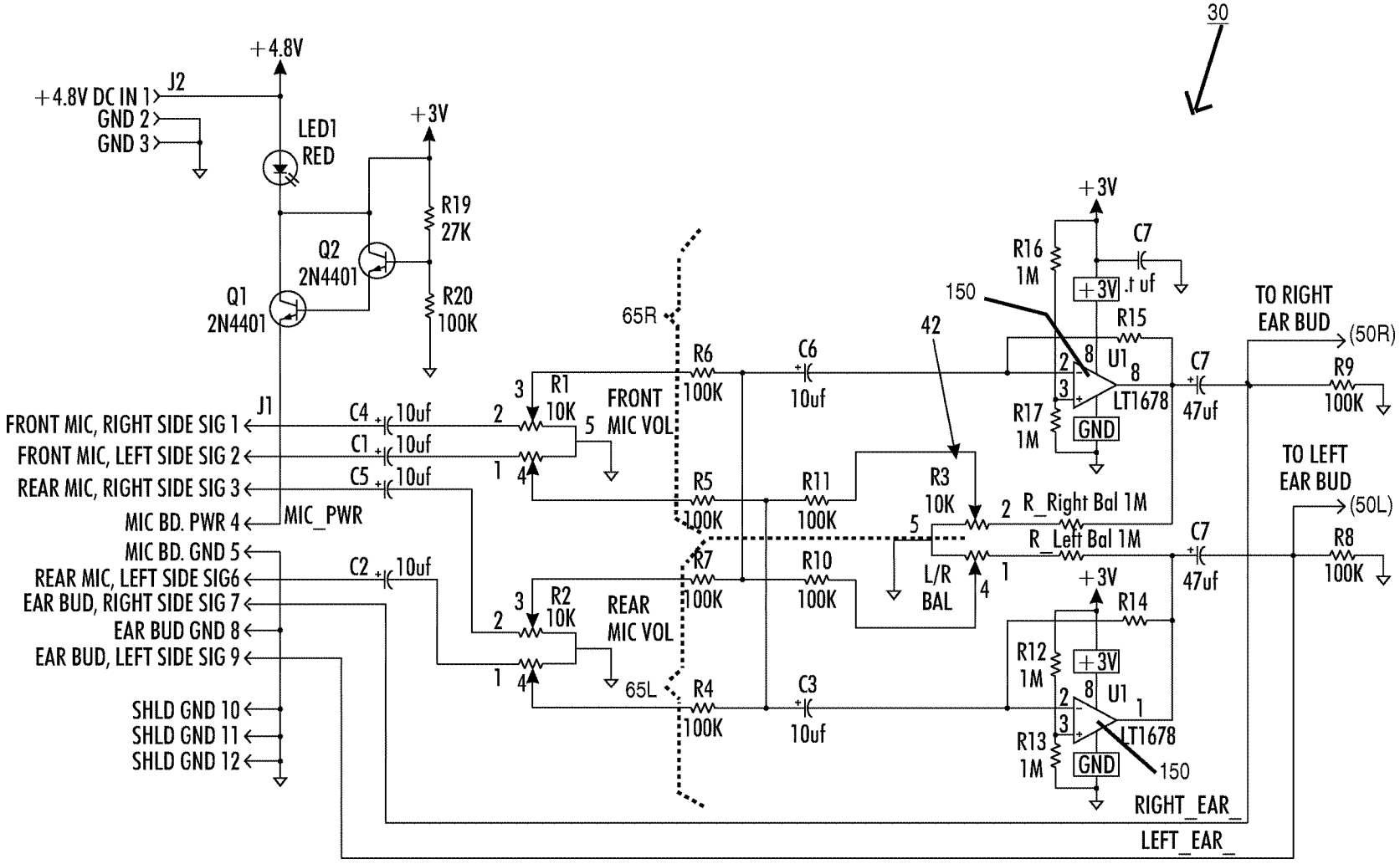
FIG. 5 is an illustration of a circuit that may be employed to process the acoustic signals in accordance with an aspect of the invention.

Also contained in each ear bud (50L, 50R) is amplification and drive circuitry associated with the microphones (see FIG. 5), as well as at least one speaker 54. The speaker 54 operates to generate an output acoustic signal in response to an output signal from the signal processing device 30, which will now be described in more detail relative to FIG. 5. As depicted in FIG. 5, the signal processing circuitry 30 and user controls 40 operate to process the inputs of microphones 24A, 24B (left and right) to produce output signals for speakers 54. Although depicted as an embodiment employing operational amplifiers 150 (LT1678), it will be appreciated that the operational amplifier or alternative devices (e.g., circuit, integrated circuit, transistor) must be suitable to both amplify the signal from the microphone (e.g., electret) and to drive the headset. It may be possible to employ standard and known components in this regard or to design alternative circuits. The schematic diagram of FIG. 5 illustrates parallel channels 65L 65R (left and right), both of which utilize an operational amplifier (op-amp) 150. Power is supplied from a plurality of batteries 170 (FIG. 3, or the battery pack 170 depicted in FIG. 4A), and input voltage protection is provided by a diode 174, which not only serves the purpose of a protection diode, but also provides an indication of the operation of the system.

Batteries 170 may be of various types, and the present invention further contemplates the use of a rechargeable battery array, where the power provided to operate the system is supplied from Nickel based or Lithium-Ion type battery(ies). In such an embodiment, the system includes one or more commercially available components such as integrated circuits that may be incorporated to facilitate the continued use of the system without having to replace batteries (e.g., battery charging components available from Linear Technology, Inc. of Milpitas, Calif.). It will be appreciated that such devices, and applications thereof, are commonly known for cellular telephones, personal digital assistants, laptop computers and various other electronic devices and games. The power-on state of user controls 40, may be indicated by a LED or similar light indicator 415, and additional indicators or display components may be present to provide feedback to the user.

Exemplary values for the various components are indicated directly on the schematic.

As depicted, for example in FIGS. 4A-4B, the system includes a separate housing for the signal processing device 30, and is connected to the ear buds 50L and 50R by a wire harness 51 having a removable, multi-pin connector 53 on the end thereof. Connector 53 is attached to signal processing device 30 as depicted in FIG. 4A. The device 30 and an associated battery pack 170 may be attached to the user using a belt (belt clip shown) or attached to the user's clothing or stored in a pocket, depending upon the user's preference.

The signal processing device 30 operates to produce, in response to the plurality of input signals from the microphones 24, at least one output signal, preferably one output signal on each channel 65L, 65R (left and right)—although a single-channel system may be employed for cost reasons in limited-capability applications. The signal processing device is characterized by a uniform frequency response such that an output acoustic signal spectrum level is generally reflective of an input acoustic signal spectrum level. It is a further characteristic of the signal processing device 30 that it operates to generate the output acoustic signal with at least a partially attenuated signal from at least one of the plurality of directions (e.g. front, rear). It will be appreciated that the characteristics of the components used may further be used to select or control the amount of attenuation achieved by the system. More importantly, the dual potentiometers (linked for front and rear in the circuit of FIG. 4B) cause the signal processing device 30 to operate to attenuate the output signal in response to a user adjustable control. As will be appreciated, the output signals (left and right) are directed to a plurality of speakers 54L and 54R, where each of the speakers receive and are responsive to one of the plurality of output signals.

In yet another embodiment it is contemplated that one or more of the hard wire connections between one or more of the microphones, signal processing unit and/or earphones (speakers) may employ short distance, low power, wireless technology including, but not limited to, radio frequency (approx. 100 MHz), Bluetooth™ (2.4 GHz), or infrared (100 GHz) or similar wireless transceivers. One impetus for such a feature, as well as cost, is found in the ability to mitigate the entanglement of wires with the musicians and their instruments. An additional advantage of wireless connectivity may be the use of microphones that are more remotely situated (spaced apart from the user) in certain circumstances where it may be desirable to do so. Furthermore, and for example, the audio control unit could be placed on a music stand, for instance, so as it was out of view of the audience but easily accessible by the musician without the added annoyance of being wired to the stand.

In accordance with another aspect of the invention a headset, similar to traditional headphones used in recording studios, is provided whereby the ear cups isolate the ears from all ambient sound. Strategically positioned microphones, within the headband, attached to the ear cups, etc., provide an acoustically blended output to the earphone as produced by the audio control unit, also located within the headset. The signal processing unit samples and modifies each of a plurality of microphone inputs as a function of the musicians adjustment of the gain controls The advantage of this self contained unit is based on convenience and comfort and is may be most practical while rehearsing—in order to preserve audio acuity as well as selective attenuation of the more profound instruments. An additional advantage to the headset version, as well as the ear bud, is to allow the microphones to "follow" the sound as you turn your head thereby providing a more realistic acoustic rendition. For example the microphones might possibly be located in eyeglasses, a hat, a hairpiece or similar apparel worn on the user's head.

In recapitulation, the present invention is a method and apparatus for controlling a user's auditory input using a smart earplug. It is, therefore, apparent that there has been provided, in accordance with the present invention, a method and apparatus for acoustic control. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An acoustic attenuation control apparatus, comprising:

an input sensor for receiving input acoustic signals to be processed, said input sensor including a microphone array, said microphone array consisting essentially of directional microphones for manifesting vibration in response to interaction with the input acoustic signals from a plurality of distinct directions in a user's surroundings to generate a plurality of input signals, each of said plurality of signals representing an acoustic input from only one of the plurality of distinct directions relative to said input sensor;

amplifiers operatively connected to said microphone array, wherein each of said plurality of input signals is amplified by one of said amplifiers prior to processing by said processing device;

a processing device for producing, in response to the plurality of distinct input signals, at least one output signal dynamically controllable by a user, said processing device generating the output signal with at least a partially attenuated signal from at least one of the plurality of distinct directions, said signal processing device further including a mixing circuit to enable a mixing of at least two acoustic signals from the plurality of distinct directions; and an acoustic output port for generating the output acoustic signal produced by said signal processing device to protect the user from hearing loss due to excessively loud acoustic signals from the at least one of the plurality of distinct directions, wherein said acoustic output port includes at least one speaker and where the apparatus further comprises at least one ear bud housing at least said microphone array, amplifier and speaker.

2. The acoustic attenuation control apparatus according to claim 1, wherein said apparatus further comprises a user control housing that encloses said processing device, said mixing circuit and a power source, wherein said housing includes at least one user-adjustable control.

3. The acoustic attenuation control apparatus according to claim 1, wherein said partially attenuated signal is perceived as being lower than an ambient sound from the same direction.

4. An acoustic signal processing system for attenuating acoustic signals in accordance with a user preference, comprising:

at least one microphone array, said microphone array including directional microphones, mounted on opposite sides of a baffle, for generating a plurality of input signals in response to acoustic vibrations, each input signal representing an acoustic input from one of a plurality of distinct directions in the user's environment as delineated by said baffle and relative to said microphone array, wherein said baffle is a circuit board having the microphones mounted on opposite sides thereof;

a signal processing device for producing, in response to the plurality of distinct input signals, at least one output signal, said signal processing device generating the output signal with at least a partially attenuated signal from at least one of the plurality of directions while maintaining a uniform frequency response, said signal processing device further including a mixing circuit, responsive to the user preference, to mix at least two acoustic signals from the plurality of distinct directions; and at least one speaker for generating the output acoustic signal in response to the output signal from said signal processing device.

5. The acoustic control apparatus according to claim 4, further comprising at least one amplifier operatively connected to said microphone array.

6. The acoustic control apparatus according to claim 4, wherein a first of said directional microphones receives acoustic vibrations from a first direction and a second of said directional microphones receives acoustic vibrations from a second direction that is opposite the first direction.

7. The acoustic control apparatus according to claim 4, wherein said partially attenuated signal from at least one of the plurality of directions results in the output acoustic signal representing the at least one of the plurality of directions at a level that is perceived as lower than the acoustic input from the at least one of the plurality of directions.

8. A method for attenuating the sound perceived by a user from at least one direction, comprising:

receiving an input acoustic signal from each of a plurality of separate directions, using a micro-electronic microphone array having microphones separated from one another by at least one baffle, where at least a first microphone only receives a first input acoustic signal from a first direction relative to the baffle and a second microphone only receives a second input acoustic signal from a second direction generally opposite the first direction and generating a plurality of input signals representing the respective acoustic input from each of a plurality of separate directions relative to the array;

processing the input signals to produce at least one output acoustic signal such that the output acoustic signal level is generally reflective of a combination of the input acoustic signals, except that one of said first and second input acoustic signals is attenuated to a lower level in the output acoustic signal; and generating, by an output speaker responsive to the at least one output signal, an acoustic signal directly in the canal of a user's ear.

9. The method of claim 8, further including occluding the canal of the user's ear with an ear bud to substantially prevent the perception of the ambient sound except that which is provided by only a single output speaker in the ear bud.

10. The method of claim 8, wherein the output signal is adjustable to include a partially attenuated input from at least one of the plurality of directions.

11. The method of claim 8 wherein receiving an input acoustic signal from each of a plurality of separate directions relative includes receiving acoustic signals from at least two directions that are generally opposite one another.

12. The method of claim 8, wherein said baffle comprises a circuit board having the microphones mounted on opposite sides thereof.

13. The method of claim 8, wherein a first microphone receives the input acoustic signal from a direction in front of the baffle and where a second microphone receives the input acoustic signal from a direction in back of the baffle.

14. The method of claim 8, wherein the attenuation of said signal results in the generation of an acoustic output signal that is perceived by the user as lower in volume than the input acoustic signal from that direction.

15. The method of claim 8, wherein said lower level is a reduced level that is safe for the user.

* * * * *